US005136853A

United States Patent [19]

Girardon et al.

[11] Patent Number: 5,136,853

[45] Date of Patent: Aug. 11, 1992

[54] DOMESTIC REFRIGERATOR HAVING A COMPARTMENT SUPPLIED WITH AN OXYGEN STARVED GAS AND PROCESS FOR FEEDING SUCH A COMPARTMENT

[75] Inventors: Philippe Girardon, Versailles; Daniel Deloche, Paris, both of France

[73] Assignee: L'Air Liquide, Societe Anonyme pour l'Etude et l'Exploitation des Procedes Georges Claude, Paris, France

[21] Appl. No.: 675,939

[22] PCT Filed: Sep. 10, 1990

[86] PCT No.: PCT/FR90/00598

§ 371 Date: Apr. 25, 1991

§ 102(e) Date: Apr. 25, 1991

[87] PCT Pub. No.: WO91/03693

PCT Pub. Date: Mar. 21, 1991

[30] Foreign Application Priority Data

Sep. 11, 1989 [FR] France ..... 89 11813

[51] Int. Cl.[5] ..... F24F 3/16

[52] U.S. Cl. ..... 62/78; 62/384

[58] Field of Search ..... 62/78, 382

[56] References Cited

U.S. PATENT DOCUMENTS 4,537,043 8/1985 Volker et al. ..... 62/78
4,961,322 10/1990 Oguma et al. ..... 62/78
5,046,332 9/1991 Herrmann et al. ..... 62/78
5,063,753 11/1991 Woodruff ..... 62/78

FOREIGN PATENT DOCUMENTS 2-8680 1/1990 Japan .

*Primary Examiner*—Ronald C. Capossela
*Attorney, Agent, or Firm*—Curtis, Morris & Safford

[57] ABSTRACT

The refrigerator, in its internal cavity (2), comprises a compartment (4) in which at least a part manually movable and defining a second internal cavity (5) which is substantially water tight with respect to the first internal cavity (2) and communicating with a gas source containing less oxygen than air, typically consisting of a separation module (17) cyclically supplied with compressed air by means of a moto-compressor unit (19).

Application to the long term domestic preservation of fruits and vegetables.

13 Claims, 1 Drawing Sheet

Figure 1:
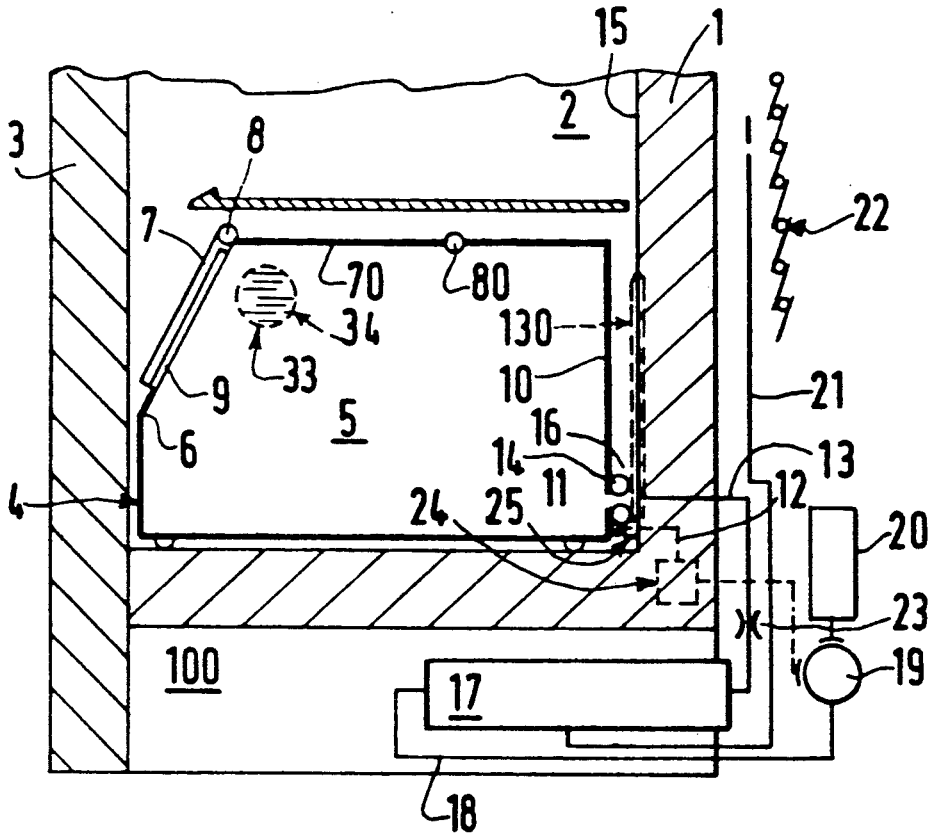

DOMESTIC REFRIGERATOR HAVING A COMPARTMENT SUPPLIED WITH AN OXYGEN STARVED GAS AND PROCESS FOR FEEDING SUCH A COMPARTMENT

The present invention concerns domestic refrigerators of the type having a refrigerator body defining a first internal refrigerated cavity, and, in this first internal cavity, at least one compartment in which at least a part is manually movable.

Known domestic refrigerators generally have two compartments of the type mentioned above, namely the compartment for making ice, commonly called "freezer", containing a refrigeration coil and closed by means of a pivoting door, and a compartment in the form of a vat, generally disposed opposite the "freezer" and serving as a removable vegetable tray, in an environment at a low temperature between 2° and 5° C.

There is a need for the consumers to be able to rely on refriferators which are provided with means enabling to substantially extend the period of preservation of fruits and vegetables, experience showing that in known vegetable trays, the vegetables have a tendency to fade or rot relatively rapidly.

Processes for extending the length of preservations of plant food products, in particular fruits and vegetables, are known, and these processes consist in placing these products under an oxygen starved controlled atmosphere and to keep them at low temperature, typically between 0° and 15° C. These processes are found either in storage silos of substantial size, where the composition of the controlled atmosphere is permanently supervised and adjusted, namely for their conditioning in wrappings intended for sale and having selective properties of gas diffusion.

It is an object of the present invention to propose a domestic refrigerator enabling to establish and maintain in a portion of its internal cavity an atmosphere adapted for the extended preservation of fruits and vegetables, in an autonomous arrangement, at low cost, with reliable operation and which does not modify the overall size of the refrigerator.

For this purpose, according to a characteristic of the invention, the compartment of the refrigerator defines a second internal cavity which is substantially water tight with respect to the first internal cavity and communicates with a gas source containing less oxygen than air.

According to a more particular characteristic of the invention, the gas source comprises a separation module periodically supplied with air under pressure, advantageously by means of a moto-compressor unit controlled by a control module comprising a timer, and preferably, coupled to a detector which is responsive to the movement of the movable part of the compartment.

It is another object of the present invention to propose a process for feeding an oxygen starved gas into a compartment of a refrigerator of the above type, enabling, at lower cost, to keep, in the compartment, an atmosphere which is adapted for the preservation of fruits and vegetables.

For this purpose, according to a characteristic of the process of the invention, during maintenance, the gas is supplied during a period $T_1$, of between about 15 and 30 minutes, following a period of non supply $T_2$, $T_2$ being high than 5 $T_1$.

Figure 2:
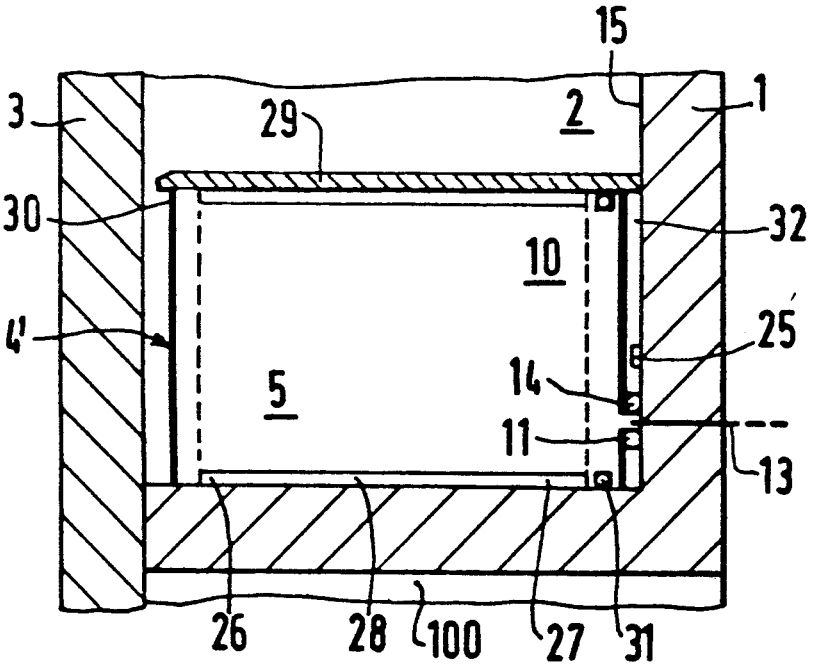

Other characteristics and advantages of the present invention will appear from the description which follows of embodiments given by way of illustration but without limitation, with reference to the annexed drawings, in which:

FIG. 1 is a schematic representation, in partial cross-section, of a first embodiment of a domestic refrigerator according to the invention, and FIG. 2 is also a schematic representation and in partial cross-section of another embodiment of domestic refrigerator according to the invention.

In the description which follows and on the drawings, identical or analogous parts are referred to by the same reference numerals, possibly indexed.

On the drawings, one recognizes the lower part of a domestic refrigerator comprising an isotherm refrigerator body 1 defining a first internal refrigerated cavity 2 closed by a pivoting access door 3. In the part of the first internal cavity 2 opposite the "freezer" (not represented), where there is a temperature between 2° and 5° C. there is provided an extractable compartment 4, 4', typically of general parallelepipedal shape defining a second internal cavity 5 substantially water tight with respect to the first internal cavity 2.

In the embodiment of FIG. 1, compartment 4 is closed on all sides and comprises, in an inclined portion of its front face, an access opening 6 normally kept closed by means of a shutter 7 which pivots about an upper joint 8, a seal 9, all around the opening 6, cooperating while in contact with the shutter 7 under the weight of the latter. To facilitate its loading, compartment 4 may include a portion 70 of its upper wall pivoting about rear axis 80, supporting joint 8 and shutter 7, and cooperating with a seal (not represented). At the lower part of the rear wall 10 of compartment 4 there is provided an orifice 11 facing an outlet end 12 of a duct 13 supplying an oxygen starved gas. A seal which is compressible and advantageously magnetic 14 is disposed around the orifice 11 to seal the interface between the latter and the end 12 of the duct 13. If the rear face 15 of the first internal cavity 2 is not made of a magnetic material, there will be provided a steel washer 16 around the outlet end 12 of the duct 13.

According to an aspect of the invention, the oxygen starved gas supplied by duct 13 is delivered by a gas source comprising a separation module 17 supplied, via duct 18, with air under pressure by means of an electric moto-compressor unit 19 whose inlet is advantageously provided with a muffler/filter unit 20.

The separation module 17 is based on a cluster of membranes with selective permeability made of a material which is more permeable to oxygen than nitrogen, for example of polyamide, polyimide, polysulfone, low density polyethylene, polycarbonate, polyphenylene oxide, polystyrene or cellulose acetate, such as described in "Encyclopedia of Chemical Technology, volume 15, page 118 (Kirk-Othmer) or in the documents U.S. Pat. No. 3 657 632, 3 822 202, Re-30 351, 413 628 or 4 707 394. The pressure reduced permeate which is oxygen enriched is placed in free air by means of a duct 21 advantageously opening in the convection zone betwen the rear wall of the refrigerator and the heat exchanger 22 of its refrigerating unit. At least a portion of the permeate and/or oxygen starved gas may be treated in a small ozonifier to be cyclically injected in first internal cavity 2 and/or in the second internal cavity in order to reduce therein the odors and possible bacterial proliferations.

Although part of the source of power has been represented outside the refrigerator per se in FIG. 1, to facilitate understanding, in practice, the sizes of the module 17 of the moto-compressor unit 19 and of the muffler 20 are such that all these elements are disposed in a housing 100 under the refrigerator.

In practice, the volume of compartment 4 is between 25 and 50 liters and the compressor 19 and the module 17 are dimensioned to supply, in the second internal cavity 5, a flow of oxygen starved gas, with a content of oxygen which is reduced to between 2 and 6 volume %, typically between 4 and 6%, of between 50 and 150 liters per hour at a pressure not exceeding $1,1\times10^5$ Pa absolute. Since compressor 19 provides for a discharge pressure of the order of 2,5 to $3\times10^5$ Pa, there will advantageously be provided, in duct 13, a constriction 23, typically consisting of a gauged orifice. The slight overpressure of the feed in the second internal cavity 5 causes, by raising the shutter 7, a leaking flow at the level of the opening 6 thereby ensuring, during the period of operation of the compressor 19, a flushing flow in the second internal cavity 5.

According to an aspect of the present invention, the supply, in compartment 4, of oxygen starved gas is carried out in batch, typically in a cyclic fashion. For this purpose, the moto-compressor 19 unit is controlled by an electronic control module 24 including a timer circuit, typically comprising a time basis with quartz oscillator or controlled by the frequency of the electrical supply network, and two timers so as to cyclically operate the moto-compressor unit 19 according to pre-established cycles.

According to another aspect of the invention, there is provided a detector 25 for determining the position of the compartment 4, advantageously disposed on the rear face 15, coupled to the control module 24 and supplying to the latter a priority control signal when compartment 4 has been reset into position in the internal cavity 2. This resetting means indeed that the compartment 4 has been opened and therefore that the controlled atmosphere in this internal cavity 5 has been destroyed and replaced by an atmosphere having an oxygen content close to that of air. The control signal given by the detector 25 prevents the operation of the timer and controls a flushing phase of compartment 4 during a period $T_0$ higher than 1 hour, typically of the order of 90 to 120 minutes, after which the operation of the moto-compressor unit 19 is interrupted for a period $T_2$, of between 2 hours 30 and 3 hours, the controlled atmosphere in the cavity 5 being thereafter regenerated by operating the moto-compressor unit 19 for a period $T_1$ typically between 15 and 30 minutes, cycles $T_2$ and $T_1$ being repeated as long as the detector 25 does not give a cutting signal indicating the removal of the compartment 4. During the rest period $T_2$, the amount of oxygen in compartment 4 progressively raises, typically from 4 to 6%. During the period of regeneration $T_2$, this amount is brought back to its desired lower value, typically between 3,5 and 4%. Thus, on a period of 24 hours, the compressor 19 operates as an average between 2 h 30 and less than 5 hours, with a consumption of the order of 10 watt/hour. With such an arrangement, fruits and vegetables may be preserved more than 18 days without perceptible modification of appearance and texture, nor of their organoleptic properties.

In the embodiment of FIG. 2, compartment 4' is in the form of a parallelepipedal vat opened at the top and including a front frame 26 and a rear frame 27 for slidably guiding it between the flat bottom 28 of the first internal cavity 2 and a stationary horizontal partition 29 having a lower flat and smooth lower face. The front frame 26 provides, with respect to the partition 29, a small play 30 constituting a vent hole for the gas introduced, by duct 13, into the second internal cavity 5. On the other hand, the rear frame 27 is provided on its periphery, with a joint 31 sealingly separating (except for orifice 11) a rear chamber 32 from the remainder of the first internal cavity 2. In this manner, when compartment 4' is manually removed to place food products thereon or remove the same therefrom, the detector 25 will cause this removal to interrupt the supply of oxygen starved gas and, in a second step, a suction effect in chamber 32 pulling into the latter a substantial portion of the oxygen starved and already cold atmosphere previously contained in the second internal cavity 5 so that, during the replacement of the compartment 4', the air which has entered in the second internal cavity 5 is being pushed by the volume of gas into chamber 32, which enables to rapidly recover, in compartment 4', an oxygen starved and cold atmosphere.

Although the present invention has been described with respect to specific embodiments, it is not limited thereby but, on the contrary, modifications and variants are possible which would appear to one skilled in the art. In particular, as represented in FIG. 1, duct 13 may include an end part 130 in the form of a loop applied on the rear face 15 of the first internal cavity 2 so as to cool the gas supplied by duct 13, which enables to facilitate the cooling of the second compartment 5 and optimize the filling of this compartment with a controlled atmosphere. On the other hand, if the design of the extractable compartment is not a requirement from the users, compartment 4 can be mounted permanently in the first internal cavity 2 and closed substantially imperviously by means of a pivoting door, as in the case of "freezers", detector 25 then being provided at the level of the door giving access to compartment 4. It is also possible to provide, in one of the walls of the compartment 4 or 4', a window 33 hidden by a membrane with selective permeability 34 allowing for the exit of carbon dioxide so as to reduce the increase of the $CO_2$ content in the second internal cavity 5 between two periods of operation of the moto-compressor 19.

We claim:

1. A refrigerator with a refrigerated storage space, comprising at least one compartment at least partially occupying the storage space and defining an inner volume for storing perishables, at least one part of the compartment being manually displaceable to give access to the inner volume, an air separation module for separating air into at least a gas flow having an oxygen content lower than the oxygen content of air, pump means coupled to the separation module for supplying the separation module with air under pressure, fluid flow transfer means disposed between the separation module and the inner volume, and control means coupled to the pump means to selectively actuate the pump means and to thereby introduce the gas flow into the inner volume.

2. The refrigerator of claim 1, wherein the control means includes timer means for actuating the pump means at timed intervals for predetermined durations.

3. The refrigerator of claim 1, further comprising sensing means for sensing displacement of the displaceable part and operatively coupled to the control means for selectively actuating and deactuating the pump means when the displaceable part has been displaced.

4. The refrigerator of claim 3, wherein the compartment is an extractable unit having a rear wall and wherein the fluid flow transfer means includes a duct for the gas flow from the separation module and releasable coupling means for coupling the duct to the rear wall of the compartment.

5. The refrigerator of claim 4, wherein the compartment comprises a front access door, and the sensing means senses opening of the door.

6. The refrigerator of claim 4, wherein the compartment is a vat slidingly disposed between two horizontal walls in the storage space, and the sensing means senses displacement of the vat.

7. The refrigerator of claim 1, wherein the separation module is a permeation membrane module.

8. The refrigerator of claim 7, wherein the pump means comprises a moto-compressor unit.

9. A refrigerator having a body defining a refrigerated internal storage space, comprising at least one compartment in the storage space and defining, in operative position in the storage space, a substantially closed inner volume, at least one part of the compartment being manually displaceable from an operative position to a removed position, sensing means for sensing displacement of the displaceable part, a membrane permeation module having an inlet, a gas product outlet and a permeate outlet, pump means connected to the inlet, a flow line extending from the product outlet and discharging into the inner volume, and control means for controlling timed operation of the pump means, the sensing means being coupled to the control means to actuate the pump means when the compartment is returned to its operative position to thereby introduce therein an oxygen-depleted atmosphere from the permeation module.

10. The refrigerator of claim 9, wherein the compartment is an extractable unit having a rear wall having an opening releasably coupled to the flow line.

11. The refrigerator of claim 10, wherein the flow line has a length in the storage space for cooling the oxygen-depleted atmosphere before its introduction into the inner volume of the compartment.

12. The refrigerator of claim 9, wherein the body has an outer bottom recess and a rear heat exchanger of a refrigeration unit, and wherein at least the membrane permeation module is housed at least partly in the bottom recess.

13. The refrigerator of claim 12, further comprising a permeate duct extending from the permeate outlet and opening adjacent the heat exchanger.

* * * * *